US011146876B2

(12) United States Patent
Choi et al.

(10) Patent No.: US 11,146,876 B2
(45) Date of Patent: Oct. 12, 2021

(54) KERNEL-TYPE EARPHONE HAVING PRESSURE BALANCE STRUCTURE

(71) Applicant: BSE Co., Ltd., Incheon (KR)

(72) Inventors: Nakgyu Choi, Incheon (KR); Eunsu Ko, Incheon (KR); Sangkyum Kim, Seoul (KR)

(73) Assignee: BSE Co., Ltd., Incheon (KR)

( * ) Notice: Subject to any disclaimer, the term of this patent is extended or adjusted under 35 U.S.C. 154(b) by 0 days.

(21) Appl. No.: 16/852,244

(22) Filed: Apr. 17, 2020

(65) Prior Publication Data

US 2021/0021920 A1 Jan. 21, 2021

(30) Foreign Application Priority Data

Jul. 18, 2019 (KR) ..... 10-2019-0087071

(51) Int. Cl.
*H04R 1/10* (2006.01)
*H04R 7/18* (2006.01)

(52) U.S. Cl.
CPC ..... *H04R 1/1016* (2013.01); *H04R 7/18* (2013.01)

(58) Field of Classification Search
CPC H04R 1/1016; H04R 1/1075; H04R 2460/11; H04R 2460/09
See application file for complete search history.

(56) References Cited

U.S. PATENT DOCUMENTS 4,852,177 A * 7/1989 Ambrose ..... H04R 1/1016 381/338
6,738,487 B1 * 5/2004 Nageno ..... H04R 1/1016 381/322
8,744,112 B2 * 6/2014 Kim ..... H04R 1/1016 381/380
9,237,394 B2 * 1/2016 Seo ..... H04R 1/1016
9,301,040 B2 * 3/2016 Annunziata ..... H04R 1/2826
11,006,196 B1 * 5/2021 Park ..... H04R 7/12
(Continued)

FOREIGN PATENT DOCUMENTS

KR 20-2008-0003044 A 8/2008
KR 10-1558091 B1 10/2015
KR 10-1952909 B1 5/2019

*Primary Examiner* — Ryan Robinson
(74) *Attorney, Agent, or Firm* — Kaplan Breyer Schwarz, LLP

(57) ABSTRACT

The present disclosure relates to a kernel-type earphone which is capable of easily implementing a pressure balance structure while hardly affecting acoustic characteristics of a speaker unit by using an existing general diaphragm and an existing general gasket.

An embodiment disclosed herein is a kernel-type earphone which includes a housing having a front portion, a rear portion, and a stepped portion formed between the front portion and the rear portion by a difference in diameter between the front portion and the rear portion, and a speaker unit mounted on the stepped portion of the housing, wherein an internal space of the housing is divided into a front chamber and a rear chamber with respect to the speaker unit mounted on the stepped portion, and an air passage between the front chamber and the rear chamber is formed by an air groove formed in a spacer ring of the speaker unit, a side gap between a case and internal components, and a through-hole formed in an edge portion of a PCB (printed circuit board).

5 Claims, 12 Drawing Sheets

(56) References Cited

U.S. PATENT DOCUMENTS

| | | | | |
|---|---|---|---|---|
| 2012/0201406 | A1* | 8/2012 | Yamaguchi | H04R 1/1016 381/309 |
| 2013/0148830 | A1* | 6/2013 | Sakaguchi | H04R 1/2873 381/312 |
| 2017/0118548 | A1* | 4/2017 | Liu | H04R 1/1016 |
| 2019/0116436 | A1* | 4/2019 | Lawand | H04R 1/1016 |
| 2019/0208301 | A1* | 7/2019 | Monti | H04R 25/652 |
| 2020/0178003 | A1* | 6/2020 | Zurbruegg | H04R 25/603 |
| 2020/0186906 | A1* | 6/2020 | Birch | H04R 1/1016 |
| 2020/0221205 | A1* | 7/2020 | Park | H04R 1/1075 |
| 2020/0288251 | A1* | 9/2020 | Kuipers | H04R 1/2803 |
| 2020/0404437 | A1* | 12/2020 | Chmielewski | A61F 11/08 |
| 2021/0144462 | A1* | 5/2021 | Kim | H04R 1/1016 |

* cited by examiner

[Fig.1]
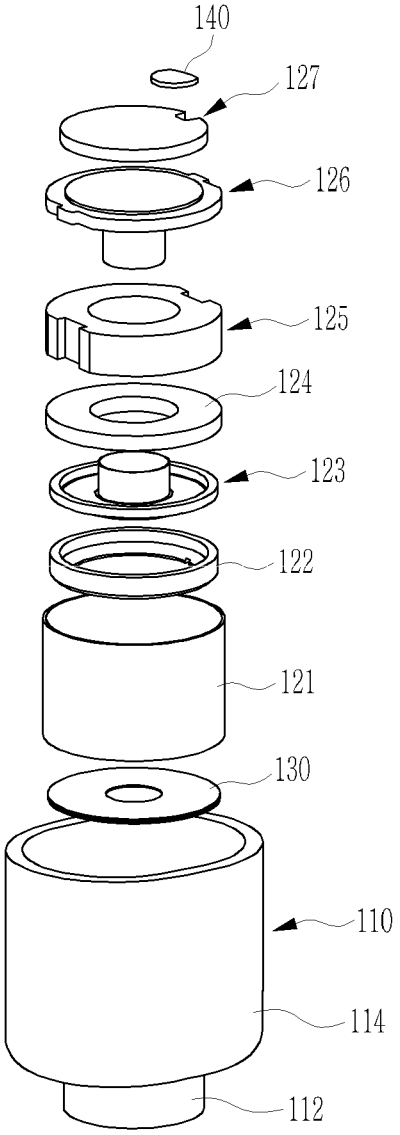

[Fig.2]
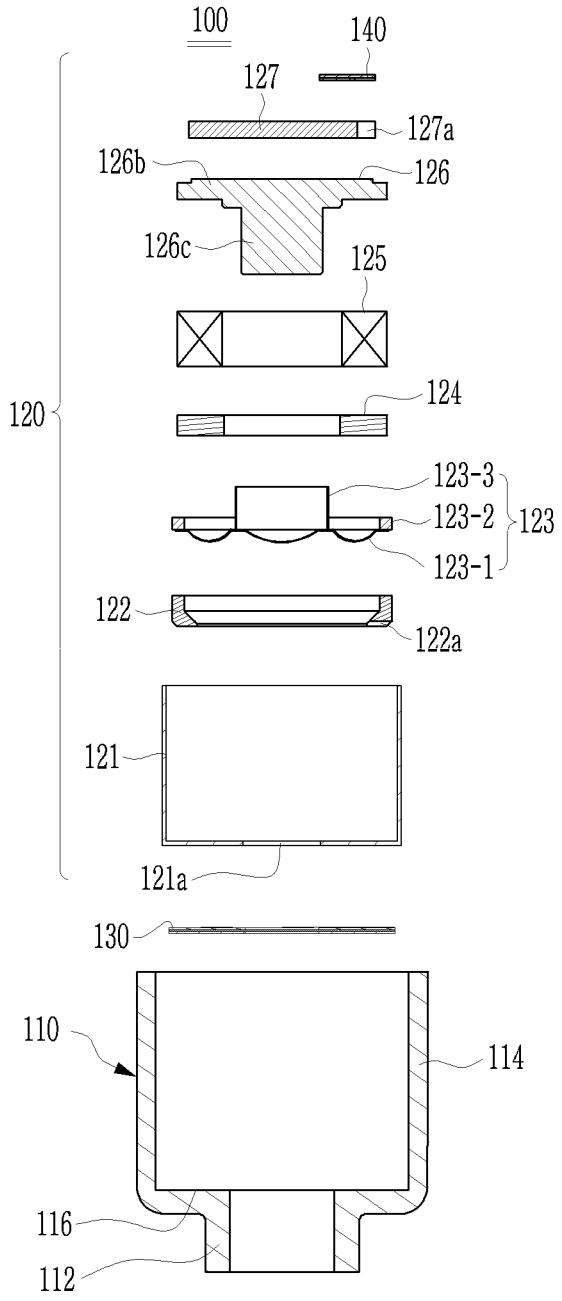

[Fig3]
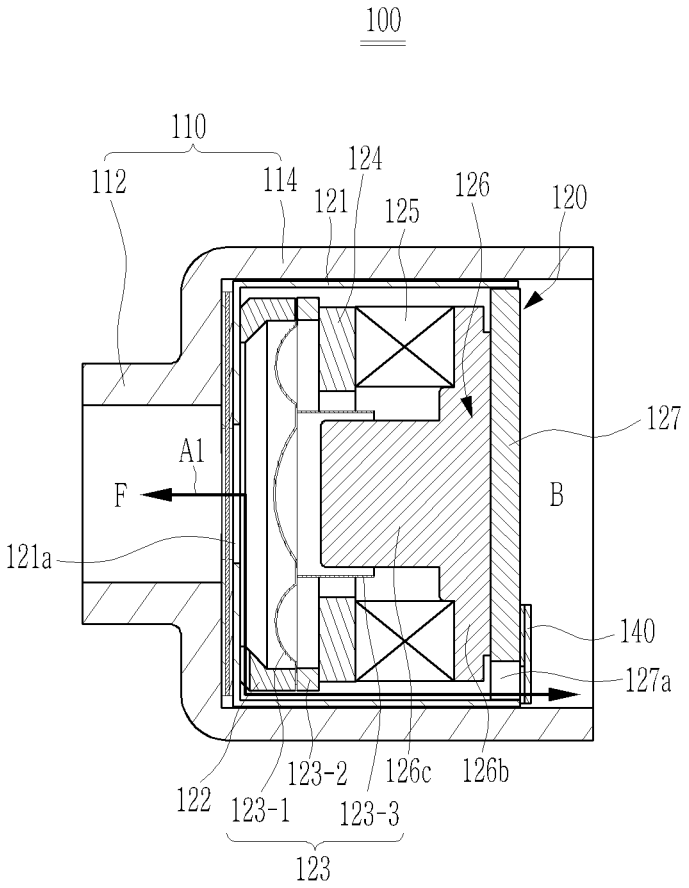

[Fig.4]
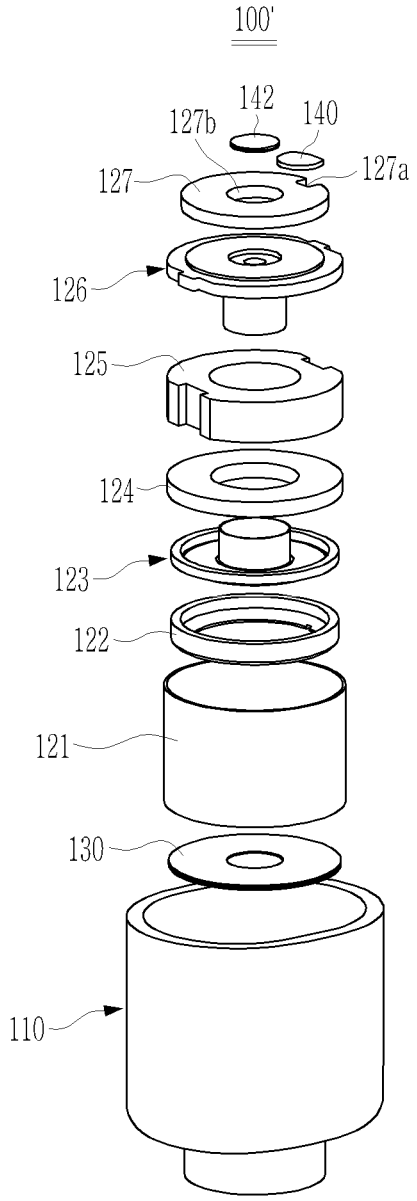

[Fig.5]
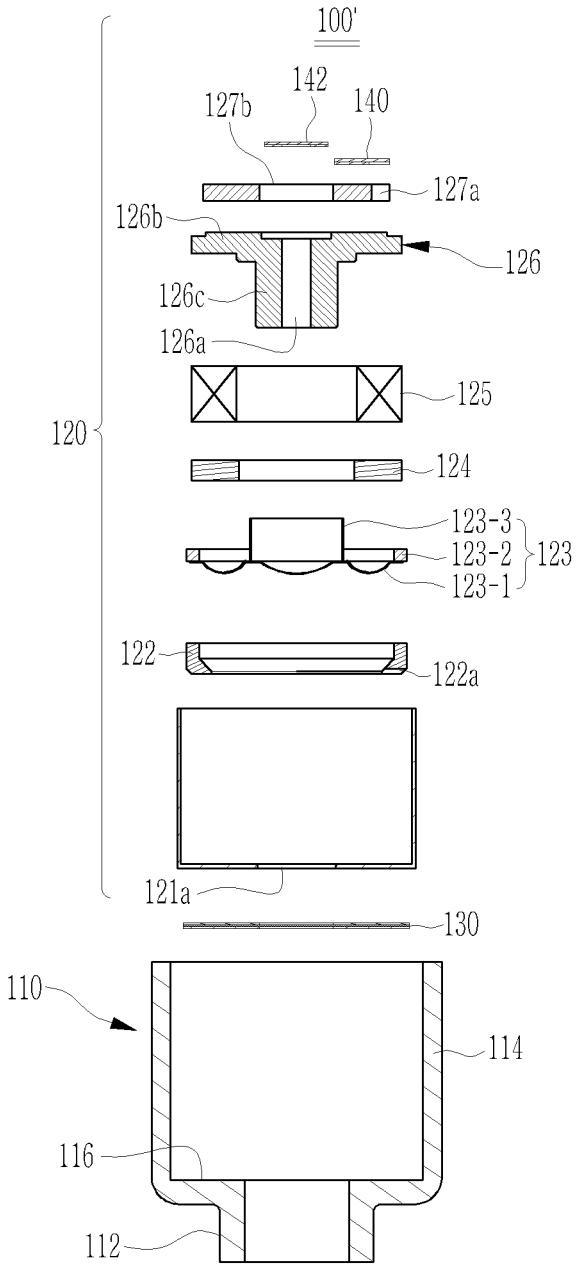

[Fig.6]
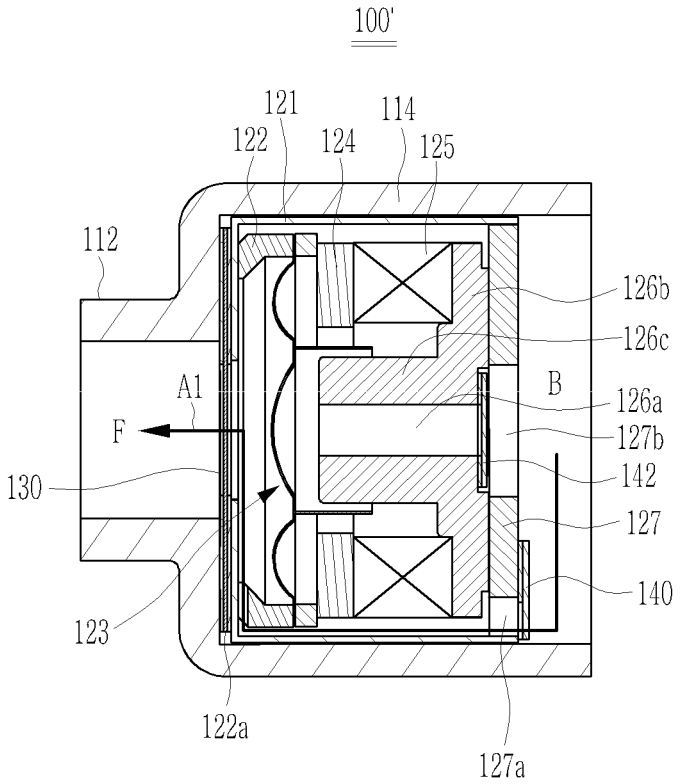

[Fig.7]
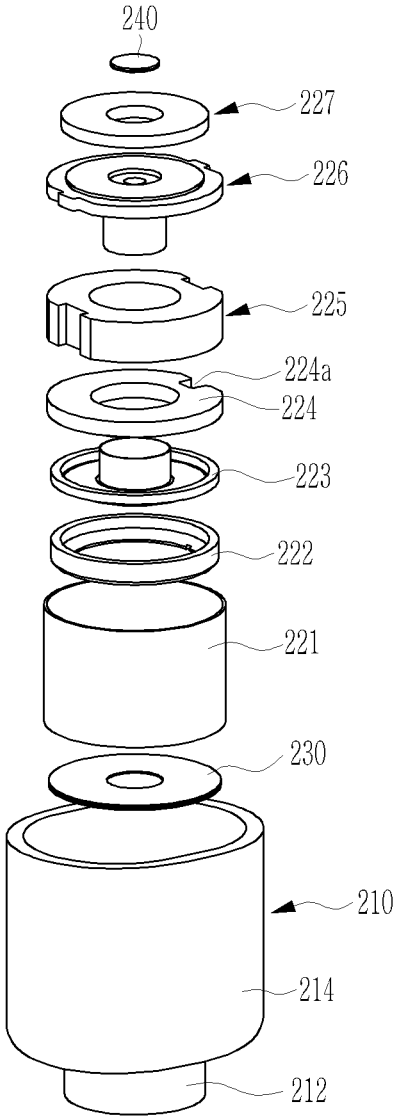

[Fig.8]
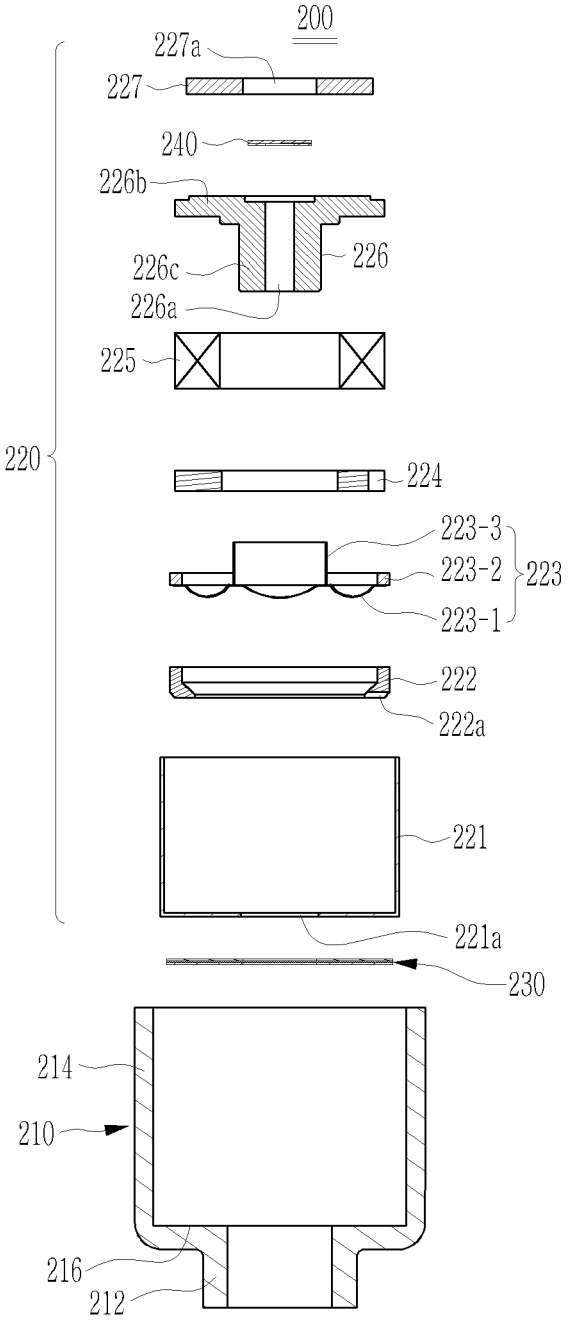

[Fig.9]
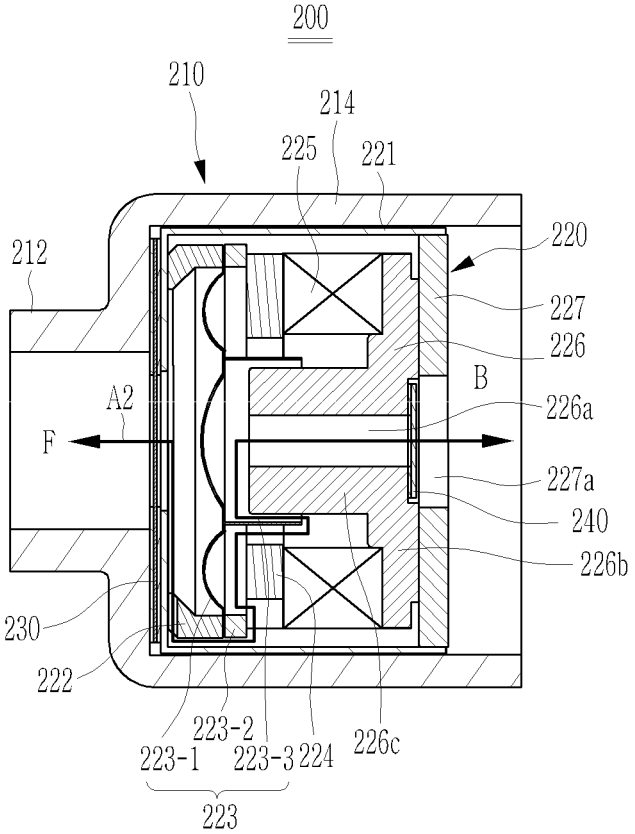

[Fig.10]
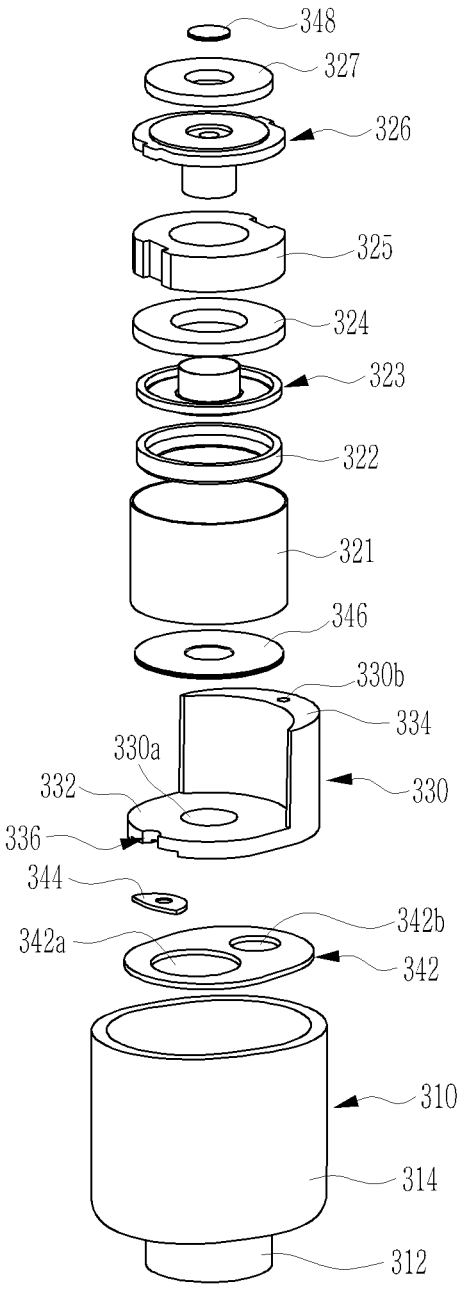

[Fig.11]
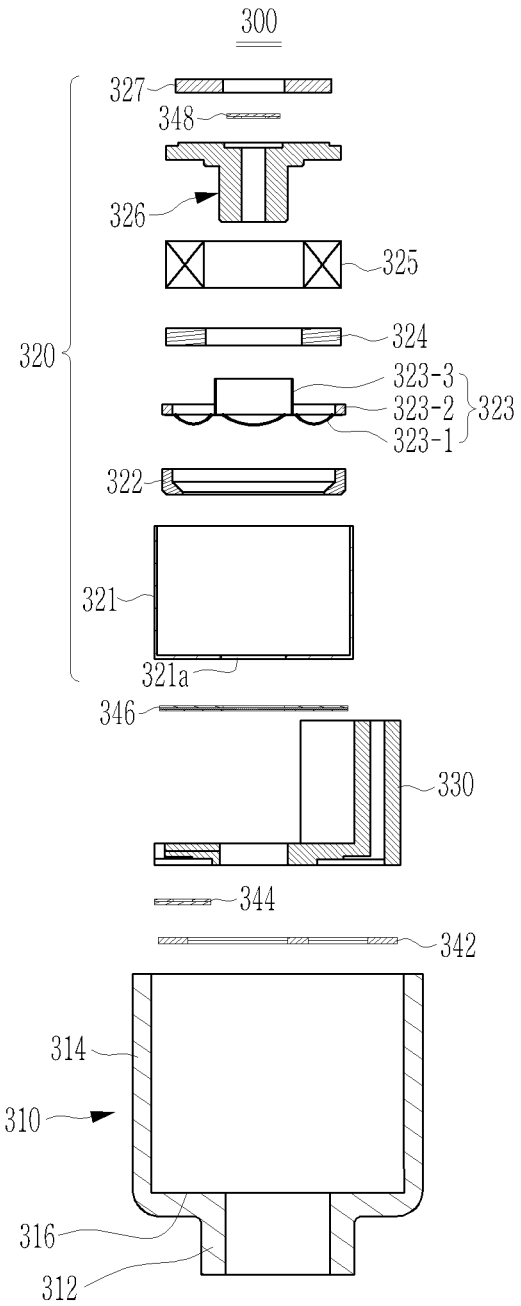

[Fig.12]
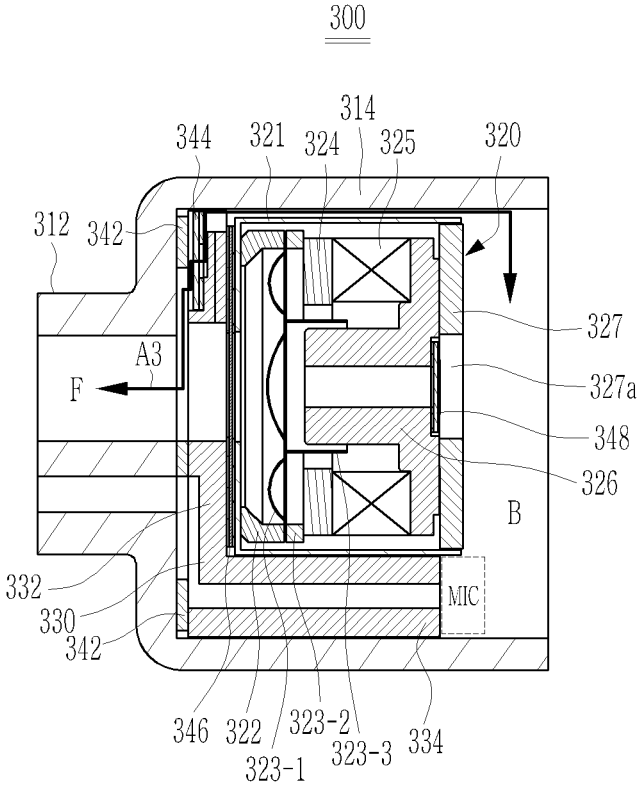

KERNEL-TYPE EARPHONE HAVING PRESSURE BALANCE STRUCTURE

CROSS-REFERENCE TO RELATED APPLICATION

This application claims priority to and the benefit of Korean Patent Application No. 10-2019-0087071 filed in the Korean Intellectual Property Office on Jul. 18, 2019, the entire contents of which are incorporated herein by reference.

BACKGROUND OF THE INVENTION

(a) Field of the Invention

The present invention relates to a kernel-type earphone, and more specifically, to a kernel-type earphone capable of easily implementing a pressure balance structure using a general diaphragm and a general gasket in the related art without affecting acoustic characteristics of the speaker unit.

(b) Description of the Related Art

In recent years, portable electronic products, such as a smartphone, a tablet PC and the like are generally used, and various types of earphones or headphones are used so as to hardly affect other people around a user when the user hears audio information using such earphones or headphones.

The earphone may be classified into an open-type one and a kernel-type one depending on the wearing manner. The kernel-type earphone typically includes a housing having an ear piece made of an elastic material mounted on an outer surface thereof. A diaphragm is arranged inside the housing toward a position where the ear piece is mounted. At the time of use, sound is transmitted to the ear in a state in which the ear piece is brought into close contact with the ear canal of the user.

When the user uses such a kernel-type earphone for a long period of time in the state in which the earphone is in close contact with the ear canal, a difference in pressure between inside and outside of the ear occurs due to the vibration of the diaphragm, which may damage to the eardrum of the user. Therefore, there has been used a technique that forms a through-hole, through which the inside and outside of the ear communicate with each other, in a portion near the ear piece of the housing, so as to eliminate a difference in pressure between an internal space of the housing and an internal space of the ear carnal in close contact with the ear piece, thus reducing pain that may be borne by the user.

Incidentally, the kernel-type earphone has a ventilation hole formed in the ear piece or the housing of the earphone. This causes a problem in that the ventilation hole formed in the ear piece or the housing is closed when wearing the earphone.

In order to solve this problem, Patent Document 1 (published as Korean Registration Patent Publication (B1) No. 10-1558091, registered in Korean Patent Office) discloses "a kernel-type earphone having an atmospheric pressure balance means" which includes a side air passage for discharging air in a tube of the kernel-type earphone or air in a speaker unit through a side surface of a gasket or a side surface of the speaker unit, and a rear air passage for discharging air through the side surface of the speaker unit backward of the speaker unit. Further, Patent Document 2 (published as Korean Registration Patent Publication (B1) No. 10-1952909) discloses "an earphone having a pressure balance structure" in which a ventilation hole is directly formed in the diaphragm to establish a pressure balance state.

However, in Patent Document 1, there is a need to use a new specially-shaped part, such as a 5-layered composite structure or a gasket made of a porous material. This increases the part cost. In Patent Document 2, a modified diaphragm having a central hole to allow an air flow to be generated in the center of the diaphragm is used. This causes a problem in that the acoustic characteristics of the speaker unit is influenced by a decrease in area of the diaphragm and the abnormal shape of the central dome.

SUMMARY

The present invention is proposed to solve the aforementioned problems, and the object of the present invention is to provide a kernel-type earphone which can easily implement pressure balance structure while maintaining the acoustic characteristics of a speaker unit by using an existing general diaphragm and a general gasket.

According to a first embodiment disclosed to achieve the above object, there is provided a kernel-type earphone which includes a housing having a front portion, a rear portion, and a stepped portion formed between the front portion and the rear portion by a difference in diameter between the front portion and the rear portion, and a speaker unit mounted on the stepped portion of the housing, wherein an internal space of the housing is divided into a front chamber and a rear chamber with respect to the speaker unit mounted on the stepped portion, and an air passage between the front chamber and the rear chamber is formed by an air groove formed in a spacer ring of the speaker unit, a side gap between a case and internal components, and a through-hole formed in an edge portion of a printed circuit board (PCB). In the speaker unit, a yoke is configured to have no through-hole.

According to a second embodiment disclosed to achieve the above object, there is provided a kernel-type earphone which includes a housing having a front portion, a rear portion, and a stepped portion formed between the front portion and the rear portion by a difference in diameter between the front portion and the rear portion, and a speaker unit mounted on the stepped portion of the housing, wherein an internal space of the housing is divided into a front chamber and a rear chamber with respect to the speaker unit mounted on the stepped portion, and an air passage is formed between the front chamber and the rear chamber through an air groove formed in a spacer ring of the speaker unit, a side gap between a case and internal components, an open portion of a plate for communicating the side gap with a gap between the plate and an yoke, a through-hole of the yoke, and a through-hole formed in the center of a PCB.

According to a third embodiment disclosed to achieve the above object, there is provided a kernel-type earphone which includes: a housing having a front portion, a rear portion, and a stepped portion formed between the front portion and the rear portion by a difference in diameter between the front portion and the rear portion; a bracket having a protruded portion formed to protrude from one side of a base, formed to have a crescent-shaped cross section, and mounted to the stepped portion of the housing, wherein the base has a through-hole for an acoustic hole and a bracket conduit for an air passage, which are formed in the base; and a speaker unit mounted on the base of the bracket, wherein an internal space of the housing is divided into a front chamber and a rear chamber with respect to the speaker unit, and the air passage is formed so that the front chamber communicate with the rear chamber through the bracket conduit and a gap formed between the rear portion of the housing and the speaker unit.

The bracket is attached to the stepped portion of the housing by a double-sided tape having a through-hole formed therein for the speaker unit.

Effects of the Present Disclosure

A kernel-type earphone according to each embodiment of the present invention provides an effect of implementing an air passage at a low cost through the use of an internal structure of a speaker unit or a bracket with existing parts instead of with a newly-structured part, such as a diaphragm having a central hole formed therein, a specially-structured gasket or the like, thus achieving cost reduction.

In addition, according to embodiments of the present invention, there is an advantage of being able to improve sound quality through pressure balance and alleviate the pain of a user even if the user uses a kernel-type earphone for a long period of time.

BRIEF DESCRIPTION OF THE DRAWINGS

FIG. 1 is an exploded perspective view illustrating a kernel-type earphone according to a first embodiment of the present invention.

FIG. 2 is an exploded cross-sectional view illustrating the kernel-type earphone according to the first embodiment of the present invention.

FIG. 3 is a cross-sectional view illustrating the kernel-type earphone in an assembled state, according to the first embodiment of the present invention.

FIG. 4 is an exploded perspective view illustrating a kernel-type earphone according to a modification of the first embodiment of the present invention.

FIG. 5 is an exploded cross-sectional view illustrating the kernel-type earphone according to the modification of the first embodiment of the present invention.

FIG. 6 is a cross-sectional view illustrating the kernel-type earphone in an assembled state, according to the modification of the first embodiment of the present invention.

FIG. 7 is an exploded perspective view illustrating a kernel-type earphone according to a second embodiment of the present invention.

FIG. 8 is an exploded cross-sectional view illustrating the kernel-type earphone according to the second embodiment of the present invention.

FIG. 9 is a cross-sectional view illustrating the kernel-type earphone in an assembled state, according to the second embodiment of the present invention.

FIG. 10 is an exploded perspective view illustrating a kernel-type earphone according to a third embodiment of the present invention.

FIG. 11 is an exploded cross-sectional view illustrating the kernel-type earphone according to the third embodiment of the present invention.

FIG. 12 is a cross-sectional view illustrating the kernel-type earphone in an assembled state, according to the third embodiment of the present invention.

DETAILED DESCRIPTION

The present invention and the technical objects to be achieved by implementing the present invention will be more apparent from preferable embodiments of the present invention, which will be described later. The following embodiments are merely examples for explaining the present invention. However, the present invention is not limited thereto.

In the present invention, embodiments of a kernel-type earphone which is capable of implementing a pressure balance structure while hardly affecting acoustic characteristics of a speaker unit by using an existing general diaphragm and an existing general gasket (screen), may be classified into a configuration in which an air passage is formed using a side gap between internal components of a speaker unit and a case, and an air groove formed in a spacer ring, and a configuration in which an air passage is formed using a separate bracket. The configuration using the side gap and the spacer ring may be further classified into a configuration using a through-hole of a printed circuit board (PCB) and a configuration using a central through-hole of a yoke. In the following description, the configuration in which the air passage is formed using the side gap, the spacer ring and the through-hole of the PCB is referred to as a first embodiment, the configuration in which the air passage is formed using the side gap, the spacer ring and the central through-hole of the yoke is referred to as a second embodiment, and the configuration in which the air passage is formed using the separate bracket is referred to as a third embodiment.

Further, in the kernel-type earphone of each embodiment, a direction toward the ear (ear canal) is defined as a front direction, a direction opposite to the front direction is defined as a rear direction. In each embodiment, an internal space of a housing is divided into a front chamber F and a rear chamber B by the speaker unit.

First Embodiment

FIG. 1 is an exploded perspective view illustrating a kernel-type earphone according to a first embodiment of the present invention, FIG. 2 is an exploded cross-sectional view illustrating the kernel-type earphone according to the first embodiment of the present invention, and FIG. 3 is a cross-sectional view illustrating the kernel-type earphone in an assembled state, according to the first embodiment of the present invention.

As illustrated in FIGS. 1 to 3, a kernel-type earphone 100 according to the first embodiment of the present invention includes a housing 110, a speaker unit 120 mounted inside the housing 110, a front screen 130, and a rear PCB screen 140. The speaker unit 120 includes a case 121, a spacer ring 122, a vibration part 123 including a diaphragm 123-1, a diaphragm (DP) ring 123-2 and a voice coil 123-3, a plate 124, a ring-shaped magnet 125, a yoke 126, and a PCB 127 having a through-hole 127*a* formed in an edge portion thereof. Further, although not shown in the figures, an ear piece made of an elastic material is mounted on a front portion 112 of the housing 110 to prevent sound from leaking out of the ear.

Referring to FIGS. 1 to 3, the housing 110 includes the front portion 112 inserted into the ear and a rear portion 114 in which components are accommodated. The front portion 112 protrudes with a smaller diameter than that of the rear portion 114 so that the front portion 112 is easy to be inserted into the ear. Further, due to such a difference in diameter, a stepped portion 116 is formed between the front portion 112 and the rear portion 114. The speaker unit 120 is typically mounted on the stepped portion 116.

Thus, an internal space of the housing 110 is divided into a front chamber F and a rear chamber B with respect to the speaker unit 120 mounted on the stepped portion 116. Sound generated in the speaker unit 120 is resonated by the front chamber F and the rear chamber B, and thus the quality of the sound can be improved.

Meanwhile, an air passage between the front chamber F and the rear chamber B may be blocked by the speaker unit 120 positioned between the front chamber F and the rear chamber B. Then, the front chamber F is sealed with the space of the ear canal so that the outer air does not flow through the front chamber F and the space. This causes a difference in pressure between the front chamber F and the rear chamber B, which may result in a degradation in sound quality, and adversely affecting the eardrum.

In the first embodiment, an air passage A1 between the front chamber F and the rear chamber B is established through an air groove 122*a* formed in the spacer ring 122 of the speaker unit 120, a side gap formed between the case 121 and internal components, and the through-hole 127*a* formed in the edge portion of the PCB 127.

The case 121 is a cylindrical tube having a closed one surface (hereinafter refers to as a bottom surface), and has an acoustic hole 121*a* formed in the bottom surface to discharge the sound generated by the vibration part 123 to the outside therethrough. The sidewall of the case 121 is flat so that speaker components can be accommodated in the internal space of the case 121. Typically, the speaker components are structured to be mounted while being in close contact with the sidewall of the case. Meanwhile, in the embodiments of the present invention, the speaker components are manufactured to have sizes smaller than that of the case 121. Thus, the side gap is formed between the case 121 and the components during assembly.

In forming the side gap as described above, assuming that the inner radius of the case 121 is referred to as R1, and the maximum radius of each of the spacer ring 122, the vibration part 123, the plate 124, the magnet 125, and the yoke 126 embedded in the case 121 is referred to as R2, R1 and R2 have the relationship of R2<R1. Thus, the side gap having the size of R1−R2=d is formed. A radius R3 of the PCB 127 mounted on the outermost side of the case 121 is identical to the inner radius R1 of the case 121. Thus, during assembly, the PCB 127 is brought into close contact with the case 121 to stably support the inner components and prevent foreign matters from being frown into the side gap. That is, in the speaker unit 120 according to the embodiment of the present invention, the side gap is formed between the inner components and the sidewall of the case 121 by sequentially stacking and bonding the yoke 126 into which the plate 124 and the magnet 125 are inserted, the diaphragm 123-1 to which the DP ring 123-2 and the voice coil 123-3 is attached, and the spacer ring 122 on the PCB 127 one above another with the centers thereof aligned with one another, and finally fitting the stacked body into the case 121 for assembly.

The spacer ring 122 is disposed on the bottom surface of the case 121 to support an edge of the diaphragm 123-1 and form a vibration space in which the diaphragm 123-1 can vibrate. The spacer ring 122 has the air groove 122*a* formed to define an air passage in a portion in contact with the bottom surface of the case 121 in a radial manner.

The diaphragm 123-1 has a central dome and an edge. The voice coil 123-3 is attached to a boundary surface between the central dome and the edge. The DP ring 123-2 is attached to the peripheral side of the edge so that the vibration space of the diaphragm 123-1 is formed by the spacer ring 122 and the DP ring 123-2. The voice coil 123-3 is coupled to a connection pattern of the PCB 127 via a signal line (not shown). The diaphragm 123-1 is configured to vibrate by an audio signal sent to the PCB 127 from the outside.

The yoke 126 has a structure in which a core 126*c* protrudes from the center of a base plate 126*b*. The ring-shaped magnet 125 and the plate 124 are engaged with the core 126*c* to form a space for receiving the voice coil 123-3 between the core 126*c* and the plate 124. The yoke 126 of the first embodiment 1 has a configuration in which no through-hole is formed in the core.

The PCB 127 includes a connection pad for connecting with the voice coil 123-3, a connection pad for receiving an external signal, a signal pattern, and the like, which are formed on the PCB 127. The PCB 127 has the through-hole 127*a* formed in an outer peripheral portion so that the side gap and the rear chamber B communicate with each other through the through-hole 127*a*. Further, a mesh-like PCB screen 140 may be attached to the outside of the through-hole 127*a* so as to adjust the entry of foreign matters into the through-hole 127*a* and an air permeability.

As shown in FIG. 3, in the kernel-type earphone 100 configured as above in the first embodiment, the air passage A1 is formed to extend from the front chamber F to the rear chamber B through the acoustic hole 121*a* of the case 121, the air groove 122*a* of the spacer ring 122, the side gap between the case 121 and the inner components, and the through-hole 127*a* of the PCB 127. This establishes an equilibrium state of pressure between the front chamber F and the rear chamber B.

When the audio signal is applied to the PCB 127 in the state where the front chamber F and the rear chamber B are kept in the pressure balanced state, a magnetic field is formed by the voice coil 123-3. The formed magnetic field interacts with a magnetic field of the magnet 125 so that the diaphragm 123-1 vibrates to generate sound. The sound is delivered into the ear of the user through the acoustic hole 121*a* and the front chamber F so that the user can hear the sound.

As described above, according to the first embodiment of the present invention, by forming the air passage A1 inside the speaker unit 120, it is possible to maintain equilibrium of air pressure between the front chamber F and the rear chamber B using a general screen instead of with a special gasket, and thus achieving cost reduction.

FIG. 4 is an exploded perspective view illustrating a kernel-type earphone according to a modification of the first embodiment of the present invention, FIG. 5 is an exploded cross-sectional view illustrating the kernel-type earphone according to the modification of the first embodiment of the present invention, and FIG. 6 is a cross-sectional view illustrating the kernel-type earphone in an assembled state, according to the modification of the first embodiment of the present invention.

A kernel-type earphone 100' according to the modification of the first embodiment is substantially identical to the kernel-type earphone 100 of the first embodiment except that a through-hole 126*a* is formed in the center of the yoke 126, an yoke screen 142 is mounted on the through-hole 126*a*, and a through-hole 127*b* is also formed in the PCB 127. Thus, the duplicate descriptions thereof will be omitted.

Second Embodiment

FIG. 7 is an exploded perspective view illustrating a kernel-type earphone according to a second embodiment of the present invention, FIG. 8 is an exploded cross-sectional view illustrating the kernel-type earphone according to the second embodiment of the present invention, and FIG. 9 is a cross-sectional view illustrating the kernel-type earphone in an assembled state, according to the second embodiment of the present invention.

As shown in FIGS. 7 to 9, a kernel-type earphone 200 according to the second embodiment of the present invention includes a housing 210, a speaker unit 220 mounted inside the housing 210, a front screen 230, and a rear PCB screen 240. The speaker unit 220 includes a case 221, a spacer ring 222, a vibration part 223 including a diaphragm 223-1, a diaphragm (DP) ring 223-2 and a voice coil 223-3, a plate 224, a ring-shaped magnet 225, a yoke 226, and a PCB 227 having a through-hole 227*a* formed in the center thereof. Further, although not shown in the figures, an ear piece made of an elastic material is mounted on a front portion 212 of the housing 210 to block sound from leaking out of the ear.

Referring to FIGS. 7 to 9, the housing 210 includes the front portion 212 inserted into the ear and a rear portion 214 in which components are accommodated. The front portion 212 protrudes with a diameter smaller than that of the rear portion 214 so that the front portion 212 is easy to be inserted into the ear. Further, due to such a difference in diameter, a stepped portion 216 is formed between the front portion 212 and the rear portion 214. The speaker unit 220 is typically mounted on the stepped portion 216.

Thus, an internal space of the housing 210 is divided into a front chamber F and a rear chamber B with respect to the speaker unit 220 mounted on the stepped portion 216. Sound generated in the speaker unit 220 is resonated by the front chamber F and the rear chamber B, and thus the quality of the sound can be improved.

Meanwhile, an air passage between the front chamber F and the rear chamber B may be blocked by the speaker unit 220 positioned between the front chamber F and the rear chamber B. Then, the front chamber F is sealed with the space of the ear canal so that the outer air does not flow through the front chamber F and the space. This causes a difference in pressure between the front chamber F and the rear chamber B, which may degrade the sound quality, and adversely affecting the eardrum.

In the second embodiment, an air passage A2 between the front chamber F and the rear chamber B is established through an air groove 222*a* formed in the spacer ring 222 of the speaker unit 220, a side gap formed between the case 221 and the internal components, an open portion 224*a* formed in the plate 224 to allow the side gap and a gap between the plate 224 and the yoke 226 to be in communication with each other, an through-hole 226*a* of the yoke 226, and the through-hole 227*a* formed in the center of the PCB 227.

The case 221 is a cylindrical tube having a closed one surface (hereinafter refers to as a bottom surface), and has an acoustic hole 221*a* formed in the bottom surface to discharge the sound generated by the vibration part 223 to the outside therethrough. The sidewall of the case 221 is flat so that speaker components can be accommodated in the case 221. Typically, the speaker components are configured to be mounted while being in close contact with the sidewall of the case. Meanwhile, in the embodiments of the present invention, the speaker components are manufactured to have sizes smaller than that of the case 221. Thus, the side gap is formed between the case 221 and the speaker components during assembly.

The spacer ring 222 is disposed on the bottom surface of the case 221 to support an edge of the diaphragm 223-1 and form a vibration space in which the diaphragm 223-1 can vibrate. The spacer ring 222 has an air groove 222*a* formed to define an air passage in a portion in contact with the bottom surface of the case 221 in a radial manner.

The diaphragm 223-1 has a central dome and an edge. The voice coil 223-3 is attached to a boundary surface between the central dome and the edge. The DP ring 223-2 is attached to the peripheral side of the edge so that the vibration space of the diaphragm 223-1 is formed by the spacer ring 222 and the DP ring 223-2. The voice coil 223-3 is coupled to a connection pattern of the PCB 227 via a signal line (not shown). The diaphragm 223-1 is configured to vibrate by an audio signal sent to the PCB 227 from the outside.

The yoke 226 has a structure in which a through-hole 226*a* is formed in the center of the yoke 226, and a core 226*c* protrudes from the center of a base plate 226*b*. The ring-shaped magnet 225 and the plate 224 are engaged with the core 226*c* to form a gap for receiving the voice coil 223-3 between the core 226*c* and the plate 224. At this time, the plate 224 has the open portion 224*a* through which the side gap is in communication with the through-hole 226*a* of the yoke 226 via the gap.

The PCB 227 includes a connection pad for connecting with the voice coil 223-3, a connection pad for receiving an external signal, a signal pattern, and the like, which are formed on the PCB 227. The PCB 227 has the through-hole 227*a* formed in the center of the PCB 227 to connect the through-hole 226*a* of the yoke 226 with the rear chamber B. Further, the rear PCB screen 240 may be attached between the through-hole 226*a* and the through-hole 227*a* so as to adjust the entry of foreign matters into the through-hole 226*a* and an air permeability.

As shown in FIG. 9, in the kernel-type earphone 200 configured as above in the second embodiment, the air passage A2 is formed to extend from the front chamber F to the rear chamber B through the acoustic hole 221*a* of the case 221, the air groove 222*a* of the spacer ring 222, the side gap between the case 221 and the inner components, the open portion 224*a* of the plate 224, the gap, the through-hole 226*a* of the yoke 226, and the through-hole 227*a* of the PCB 227. This establishes a pressure balanced state of atmospheric pressure between the front chamber F and the rear chamber B.

When the audio signal is applied to the PCB 227 in the state where the front chamber F and the rear chamber B are kept in the equilibrium state, a magnetic field is formed by the voice coil 223-3. The formed magnetic field interacts with a magnetic field of the magnet 225 so that the diaphragm 223-1 vibrates to generate sound. The sound is delivered into the ear of the user through the acoustic hole 221*a* and the front chamber F so that the user can hear the sound.

As described above, according to the second embodiment of the present invention, by forming the air passage A2 inside the speaker unit 220, it is possible to maintain the equilibrium of the air pressure between the front chamber F and the rear chamber B using a general screen instead of with a special gasket.

Third Embodiment

FIG. 10 is an exploded perspective view illustrating a kernel-type earphone according to a third embodiment of the present invention, FIG. 11 is an exploded cross-sectional view illustrating the kernel-type earphone according to the third embodiment of the present invention, and FIG. 12 is a cross-sectional view illustrating the kernel-type earphone in an assembled state, according to the third embodiment of the present invention.

As shown in FIGS. 10 to 12, a kernel-type earphone 300 according to the third embodiment of the present invention includes a housing 310, a speaker unit 320 mounted inside the housing 310, a bracket 330 mounted inside the housing 310, a double-sided tape 342, a bracket screen 344, a front screen 346, and a yoke screen 348. The speaker unit 320 includes a case 321, a spacer ring 322, a vibration part 323 including a diaphragm 323-1, a diaphragm (DP) ring 323-2 and a voice coil 323-3, a plate 324, a ring-shaped magnet 325, a yoke 326, and a PCB 327 having a through-hole 327*a* formed in the center thereof. Further, although not shown in the figures, an ear piece made of an elastic material is mounted on a front portion 312 of the housing 310 to block sound from leaking out of the ear.

Referring to FIGS. 10 to 12, the housing 310 of the third embodiment is similar in configuration to the housings 110 and 210 of the first and second embodiments described above except that the bracket 330 to which the speaker unit 320 for generating sound, a microphone (MIC) 350 and the like are attached is arranged in an internal space of the housing 310 in a parallel relationship with the housing 310.

Further, in the third embodiment, an air passage A3 between the front chamber F and the rear chamber B is established by a conduit 336 formed in the bracket 330, and a gap formed between the speaker unit 320 and the sidewall of the housing 310 instead of with an inner path of the speaker unit 320.

The speaker unit 320 includes a case 321, a spacer ring 322, a vibration part 323 provided with a diaphragm 323-1, a diaphragm (DP) ring 323-2 and a voice coil 323-3, a plate 324, a magnet 325, a yoke 326, and a PCB 327. In the third embodiment, it is not necessary to form an air passage inside the speaker unit 320. This eliminates a need to form an air groove in the spacer ring 322, or form an open portion in the plate 324. Thus, a typical speaker unit may be used.

As shown in FIG. 10, the bracket 330 is configured to have a protruded portion 334 protruding from one side of a base 332 and having a crescent-shaped cross section. The microphone (MIC) 350 or the like may be mounted on the end of the protruded portion 334. The speaker unit 320 may be mounted on the base 332. A through-hole 330*b* for the microphone (MIC) 350 or the like is formed in the protruded portion 334. Further, a through-hole 330*a* is formed in a position corresponding to an acoustic hole 321*a* of the speaker unit 320. A bracket conduit 336 for an air passage A3 is formed in a portion of the bottom surface of the base 332. The bracket 330 configured as above is attached on a stepped portion 316 of the housing 310 by the double-sided tape 342 having a speaker-purpose through-hole 342*a* and a microphone-purpose through-hole 342*b*.

The bracket screen 344 may be positioned on the bracket conduit 336. The front screen 346 may be attached on a front surface of the speaker unit 320. The yoke screen 348 may be positioned between a through-hole of the yoke 326 and the PCB 327. The bracket screen 344, the front screen 346, the yoke screen 348 and the like are provided to block foreign matters from passing therethrough and to adjust air permeability, just like a general screen.

As shown in FIG. 12, the air passage A3 in the third embodiment is established such that the front chamber F communicates with the rear chamber B through the speaker-purpose through-hole 342*a* formed in the double-sided tape 342, the bracket conduit 336, and the gap formed between the rear portion 314 of the housing 310 and the speaker unit 320.

According to the third embodiment described above, by forming the air passage A3 using the bracket 330 for mounting the microphone thereon, it is possible to maintain the balanced state of the air pressure between the front chamber F and the rear chamber B using a general screen instead of with a special gasket. Thus, it is possible to achieve cost reduction.

While exemplary embodiments of the present invention have been described as described above with reference to the drawings, various modifications and other equivalent embodiments may be made by those skilled in the art.

What is claimed is:

1. A kernel-type earphone having a pressure balance structure, which includes a housing having a front portion, a rear portion, and a stepped portion formed between the front portion and the rear portion by a difference in diameter between the front portion and the rear portion, and a speaker unit mounted on the stepped portion of the housing, wherein an internal space of the housing is divided into a front chamber and a rear chamber with respect to the speaker unit mounted on the stepped portion, the speaker unit comprising:

a case, which is a cylindrical tube having a closed one surface as a bottom surface, having an acoustic hole formed in the bottom surface to discharge a sound generated by a diaphragm to an outside therethrough, wherein a sidewall of the case is flat so that speaker components are capable of being accommodated in an internal space of the case;

a spacer ring disposed on the bottom surface of the case to support an edge of the diaphragm and form a vibration space in which the diaphragm vibrates, and having an air groove formed to define an air passage in a portion in contact with the bottom surface of the case in a radial manner;

the diaphragm;

a diaphragm ring configured to support the edge of the diaphragm;

a voice coil having one surface attached to the diaphragm and the other surface arranged on a gap and configured to vibrate the diaphragm;

a ring-shaped magnet;

a plate attached to the ring-shaped magnet;

a yoke having a configuration in which a core protrudes from a center of a base plate, wherein the ring-shaped magnet and the plate are engaged with the core so that a gap is formed between the core and the plate to accommodate the voice coil therein; and a printed circuit board (PCB) having a through-hole formed in an edge portion thereof and configured to be coupled with the case to fix the components in the internal space of the case, wherein an outer diameter of the PCB is equal to an inner diameter of the case, and a maximum outer diameter of each of the spacer ring, the diaphragm, the diaphragm ring, and the yoke is smaller than the inner diameter of the case, so that a side gap is formed between the components and the case, wherein an air passage is formed between the front chamber and the rear chamber without having to use a gasket.

2. The kernel-type earphone of claim 1, wherein the yoke has a through-hole formed in the center thereof.

3. A kernel-type earphone having a pressure balance structure, which includes a housing having a front portion, a rear portion, and a stepped portion formed between the front portion and the rear portion by a difference in diameter between the front portion and the rear portion, and a speaker unit mounted on the stepped portion of the housing, wherein an internal space of the housing is divided into a front chamber and a rear chamber with respect to the speaker unit mounted on the stepped portion, the speaker unit comprising:

a case, which is a cylindrical tube having a closed one surface as a bottom surface, having an acoustic hole formed in the bottom surface to discharge a sound generated by a diaphragm to an outside therethrough, wherein a sidewall of the case is flat so that speaker components are capable of being accommodated in an internal space of the case;

a spacer ring disposed on the bottom surface of the case to support an edge of the diaphragm and form a vibration space in which the diaphragm vibrates, and having an air groove formed to define an air passage in a portion in contact with the bottom surface of the case in a radial manner;

the diaphragm;

a diaphragm ring configured to support the edge of the diaphragm;

a voice coil having one surface attached to the diaphragm and the other surface arranged on a gap and configured to vibrate the diaphragm;

a ring-shaped magnet;

a plate attached to the ring-shaped magnet and having an open portion through which a side gap is in communication with a through-hole of a yoke via a gap;

a yoke having a through-hole formed in a center thereof and having a configuration in which a core protrudes from the center of a base plate, wherein the ring-shaped magnet and the plate are engaged with the core so that a gap is formed between the core and the plate to accommodate the voice coil therein; and a PCB having a through-hole formed in a center thereof and configured to be coupled with the case to fix the components in the internal space of the case, wherein an outer diameter of the PCB is equal to an inner diameter of the case, and a maximum outer diameter of each of the spacer ring, the diaphragm, the diaphragm ring, and the yoke is smaller than the inner diameter of the case, so that the side gap is formed between the components and the case, wherein an air passage is formed between the front chamber and the rear chamber through the air groove formed in the spacer ring of the speaker unit, the side gap between the case and the components, the open portion of the plate for communicating the side gap with the gap between the plate and the yoke, the through-hole of the yoke, and the through-hole formed in the center of the PCB.

4. A kernel-type earphone having a pressure balance structure, comprising:

a housing having a front portion, a rear portion, and a stepped portion formed between the front portion and the rear portion by a difference in diameter between the front portion and the rear portion;

a bracket having a protruded portion formed to protrude from one side of a base, formed to have a crescent-shaped cross section, and mounted to the stepped portion of the housing, wherein the base has a through-hole for an acoustic hole and a bracket conduit for an air passage, which are formed in the base; and a speaker unit mounted on the base of the bracket, wherein an internal space of the housing is divided into a front chamber and a rear chamber with respect to the speaker unit, wherein the air passage is formed so that the front chamber is in communication with the rear chamber through the bracket conduit and a gap formed between the rear portion of the housing and the speaker unit.

5. The kernel-type earphone of claim 4, wherein the bracket is attached to the stepped portion of the housing by a double-sided tape having a through-hole formed therein for the speaker unit.

* * * * *